US005931026A

United States Patent [19]

Chang

[11] Patent Number: 5,931,026

[45] Date of Patent: Aug. 3, 1999

[54] DYEING MACHINE

[76] Inventor: Chi-Lung Chang, P.O. Box 82-144, Tao-Yuan Hsien, Taiwan

[21] Appl. No.: 08/912,024

[22] Filed: Aug. 15, 1997

[51] Int. Cl.[6] ..... D06B 3/28

[52] U.S. Cl. ..... 68/4; 68/178

[58] Field of Search ..... 68/177, 178, 4

[56] References Cited

U.S. PATENT DOCUMENTS

| | | | |
|---|---|---|---|
| 3,982,411 | 9/1976 | Kreitz | 68/177 |
| 4,981,025 | 1/1991 | Brazzoli | 68/178 |
| 5,335,516 | 8/1994 | Hsiang | 68/4 |

*Primary Examiner*—Philip R. Coe
*Attorney, Agent, or Firm*—A & J

[57] ABSTRACT

A dyeing machine including a machine base defining a cylindrical receiving chamber and a cloth passage, a jet nozzle disposed in a horizontal position, an overflow nozzle disposed in a vertical position above the elevation of the jet nozzle, a first cloth guide roller disposed in front of the jet nozzle and adapted for guiding a piece of cloth from the cloth passage over the jet nozzle into the cylindrical receiving chamber for dyeing, a second cloth guide roller suspended above the overflow nozzle and adapted for guiding a piece of cloth from the cloth passage over the overflow nozzle into the cylindrical receiving chamber for dyeing.

1 Claim, 3 Drawing Sheets

DYEING MACHINE

BACKGROUND OF THE INVENTION

The present invention relates to dyeing machines, and more particularly to such a dyeing machine which comprises an overflow nozzle disposed in a vertical position, a jet nozzle horizontally disposed at a lower elevation than the overflow nozzle, a first cloth guide roller disposed in front of the jet nozzle and adapted for guiding a piece of cloth over the jet nozzle for dyeing, a second cloth guide roller suspended above the overflow nozzle and adapted for guiding a piece of cloth over the overflow nozzle for dyeing.

A regular dyeing machine is generally equipped with an overflow nozzle for dyeing knitted fabrics or cloths made of short fibers, and a jet nozzle for dyeing woven fabrics or cloths made of filament. FIG. 1 shows a dyeing machine of this type in which the overflow nozzle (non-pressure dyeing nozzle) and the jet nozzle (pressured dyeing nozzle) are disposed at different locations, and a cloth guide roller is suspended above the overflow nozzle and the jet nozzle for guiding a piece of cloth over the overflow nozzle and the jet nozzle for dyeing. Because only one cloth guide roller is provided for cloth guiding, different kinds of cloths cannot be maintained at different tensions for different dyeing operations.

SUMMARY OF THE INVENTION

The present invention uses two cloth guide rollers for guiding different kinds of cloths so that the cloth to be dyed can be moved over the corresponding nozzle at a high speed for dyeing efficiently without causing a wrinkle. According to the preferred embodiment of the present invention, the dyeing machine comprises a machine base defining a cylindrical receiving chamber and a cloth passage, a jet nozzle disposed in a horizontal position, an overflow nozzle disposed in a vertical position above the elevation of the jet nozzle, a first cloth guide roller disposed in front of the jet nozzle and adapted for guiding a piece of cloth from the cloth passage over the jet nozzle into the cylindrical receiving chamber for dyeing, a second cloth guide roller suspended above the overflow nozzle and adapted for guiding a piece of cloth from the cloth passage over the overflow nozzle into the cylindrical receiving chamber for dyeing.

DETAILED DESCRIPTION OF THE PREFERRED EMBODIMENT

Figure 1:
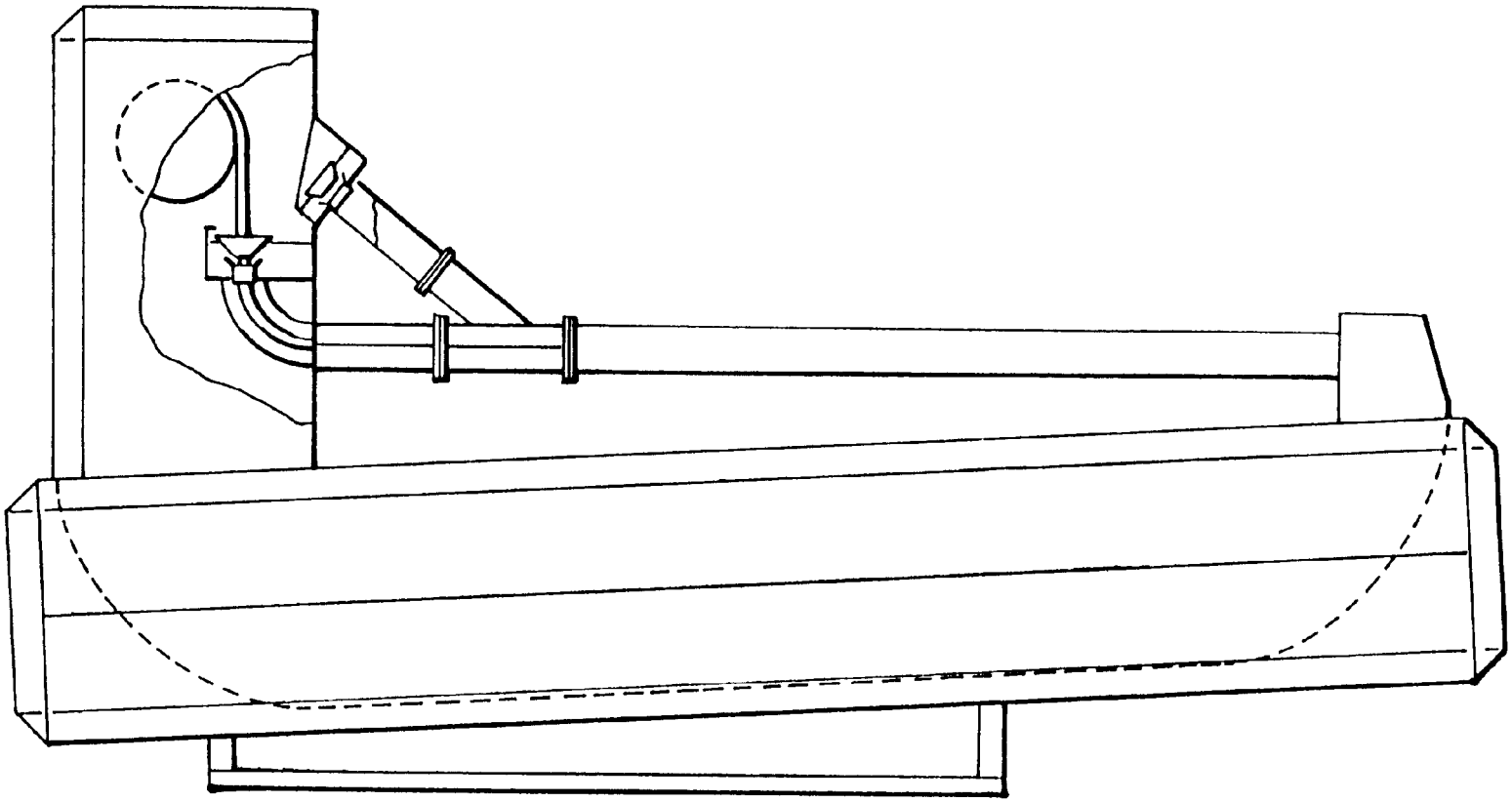
FIG. 1 PRIOR ART
FIG. 1 is a plain view of a dyeing machine according to the prior art.
Figure 2:
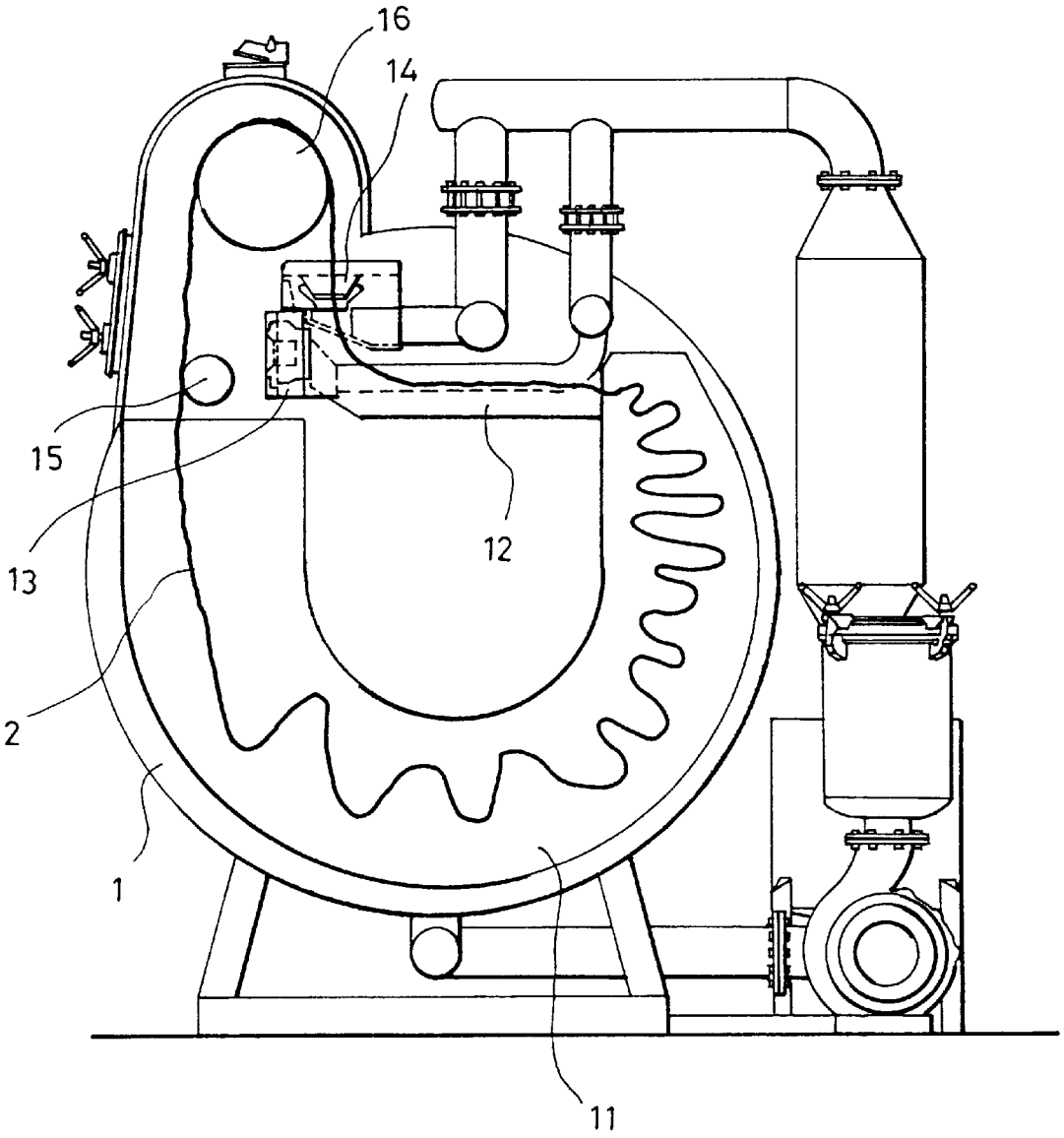
FIG. 2 is a plain view of the present invention, showing a piece of cloth moved over the overflow nozzle.

Referring to FIG. 2, a dyeing machine in accordance with the present invention is generally comprised of a machine base 1 defining a cylindrical receiving chamber 11 and a cloth passage 12, an overflow nozzle 14 and a jet nozzle 13 respectively suspended above the machine base 1, a first cloth guide roller 15 disposed in front of the jet nozzle 13, a second cloth guide roller 16 suspended above the overflow nozzle 14. The jet nozzle 13 is disposed in a horizontal position. The overflow nozzle 14 is disposed in a vertical position above the elevation of the jet nozzle 13. The diameter of the second cloth guide roller 16 is not less than that of the first cloth guide roller 15.

Figure 3:
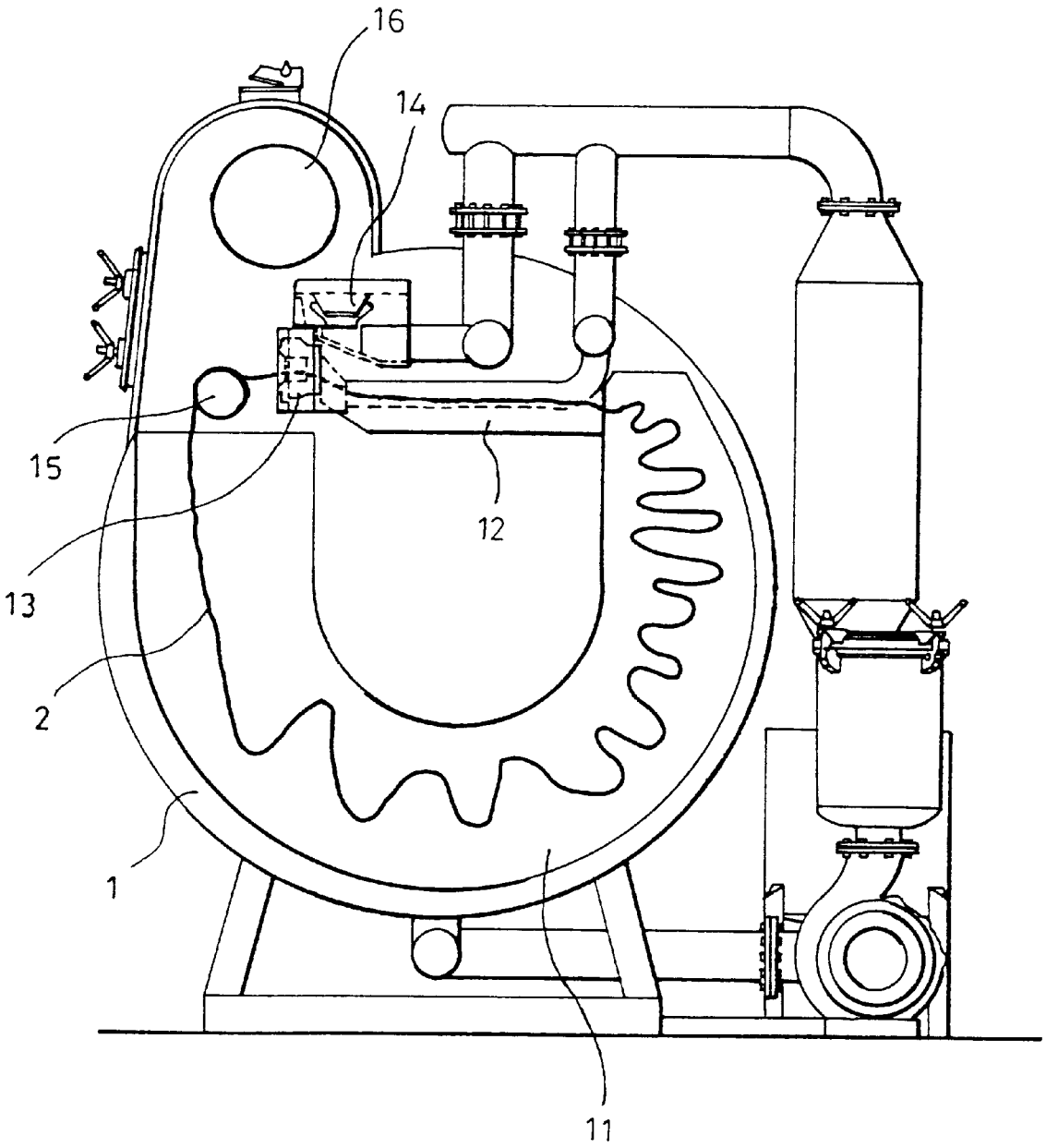
FIG. 3 is another plain view of the present invention, showing a piece of cloth moved over the jet nozzle.

Referring to FIG. 3 and FIG. 2 again, when a piece of cloth 2 is delivered into the machine base 1, it is moved in the receiving chamber 11. If the piece of cloth 2 is of knitted fabric or made of short fibers, it is guided over the overflow nozzle 14 by the first cloth guide roller 15 and the second cloth guide roller 16 to circulate through the cloth passage 12 and the cylindrical receiving chamber 11 and moved vertically over the overflow nozzle 14 and dyed by a liquid coloring matter supplied from the overflow nozzle 14 (see FIG. 2). If the piece of cloth 2 is a woven fabric made from filament, it is guided by the first cloth guide roller 15 into the cylindrical receiving chamber and horizontally moved over the jet nozzle 13 and dyed by a liquid coloring matter driven out of the jet nozzle 13.

While only one embodiment of the present invention has been shown and described, it will be understood that various modifications and changes could be made thereunto without departing from the spirit and scope of the invention disclosed.

What the invention claimed is:

1. A dyeing machine comprising a machine base defining a cylindrical receiving chamber and a cloth passage, an overflow nozzle and a jet nozzle respectively suspended above said machine base and respectively controlled to provide a liquid coloring matter for dyeing cloth, wherein said jet nozzle is disposed in a horizontal position and in communication with said cloth passage; said overflow nozzle is disposed in a vertical position above the elevation of said jet nozzle and in communication with said cloth passage; a first cloth guide roller is disposed in front of said jet nozzle and adapted for selectively guiding a piece of cloth from said cloth passage over said jet nozzle into said cylindrical receiving chamber for dyeing; a second cloth guide roller is suspended above said overflow nozzle and adapted for selectively guiding a piece of cloth from said cloth passage over said overflow nozzle into said cylindrical receiving chamber for dyeing; a single pump operatively connected with said jet nozzle and said overflow nozzle; the diameter of said second cloth guide roller is not less than that of said first cloth guide roller.

* * * * *